US006370780B1

(12) United States Patent
Robertson et al.

(10) Patent No.: US 6,370,780 B1
(45) Date of Patent: Apr. 16, 2002

(54) SPRING-BIASED CUTTING TOOL FOR PLASTIC PIPES

(75) Inventors: Duane D. Robertson, 122 Loveland Way, Golden, CO (US) 80401; Rodney G. May, Arvada; Kit N. Robertson, Yuma, both of CO (US)

(73) Assignee: Duane D. Robertson, Golden, CO (US)

( * ) Notice: Subject to any disclaimer, the term of this patent is extended or adjusted under 35 U.S.C. 154(b) by 0 days.

(21) Appl. No.: 09/751,085

(22) Filed: Dec. 29, 2000

(51) Int. Cl.[7] ..... B26B 13/00
(52) U.S. Cl. ..... 30/261; 30/92
(58) Field of Search ..... 30/261, 262, 92, 30/258; 81/417

(56) References Cited

U.S. PATENT DOCUMENTS

| | | | | | |
|---|---|---|---|---|---|
| 191,416 | A | | 5/1877 | Fetter | |
| 217,583 | A | | 7/1879 | Cannon | |
| 352,560 | A | | 11/1886 | Neff, Jr. | |
| 371,476 | A | * | 10/1887 | Reese | 81/417 X |
| 392,717 | A | | 11/1888 | Carson | |
| 929,749 | A | | 8/1909 | Bishop | |
| 1,261,284 | A | | 4/1918 | Phelps | |
| 1,702,801 | A | | 2/1929 | Smith | |
| 1,757,173 | A | | 5/1930 | Dingman et al. | |
| 1,802,903 | A | | 4/1931 | Bryant | |
| 2,006,133 | A | | 6/1935 | Fowler | |
| 3,176,551 | A | * | 4/1965 | Hansen | 81/417 X |
| 3,257,723 | A | | 6/1966 | Cercone | |
| 3,562,908 | A | | 2/1971 | Rogers | |
| 4,073,059 | A | | 2/1978 | Wallace et al. | |
| 4,336,652 | A | | 6/1982 | Robertson | |
| D266,736 | S | | 11/1982 | Robertson | |
| 4,400,876 | A | | 8/1983 | Brown | |
| 4,633,587 | A | | 1/1987 | Harrison | |
| 5,058,277 | A | | 10/1991 | Kishimoto | |
| 5,203,084 | A | | 4/1993 | Kuo | |
| 5,522,289 | A | * | 6/1996 | Eggert | 81/417 |
| 5,860,568 | A | | 1/1999 | Mallalieu et al. | |
| 5,930,900 | A | | 8/1999 | Chang | |
| 5,946,852 | A | | 9/1999 | Parrish | |

FOREIGN PATENT DOCUMENTS

| | | | | |
|---|---|---|---|---|
| GB | 1196023 | | 6/1970 | |
| GB | 4443401 | * | 7/1976 | 81/417 |

* cited by examiner

*Primary Examiner*—Douglas D. Watts
(74) *Attorney, Agent, or Firm*—W. Scott Carson

(57) ABSTRACT

A spring-biased cutting tool for plastic pipes. The tool includes two elongated members pivotally connected to each other in a scissors-like manner. Each elongated member has a handle portion and a jaw portion with one jaw portion including a knife blade and the other an anvil. To assemble the elongated members, one of them is provided with a central aperture or hole through which the other member can be passed to form the scissors-like shape. A leaf spring in then clipped at one end over an edge portion of the aperture and extends across to abut against the other elongated member and bias the handles of the tool apart and the jaws of the tool is open to receive a pipe to be cut.

10 Claims, 3 Drawing Sheets

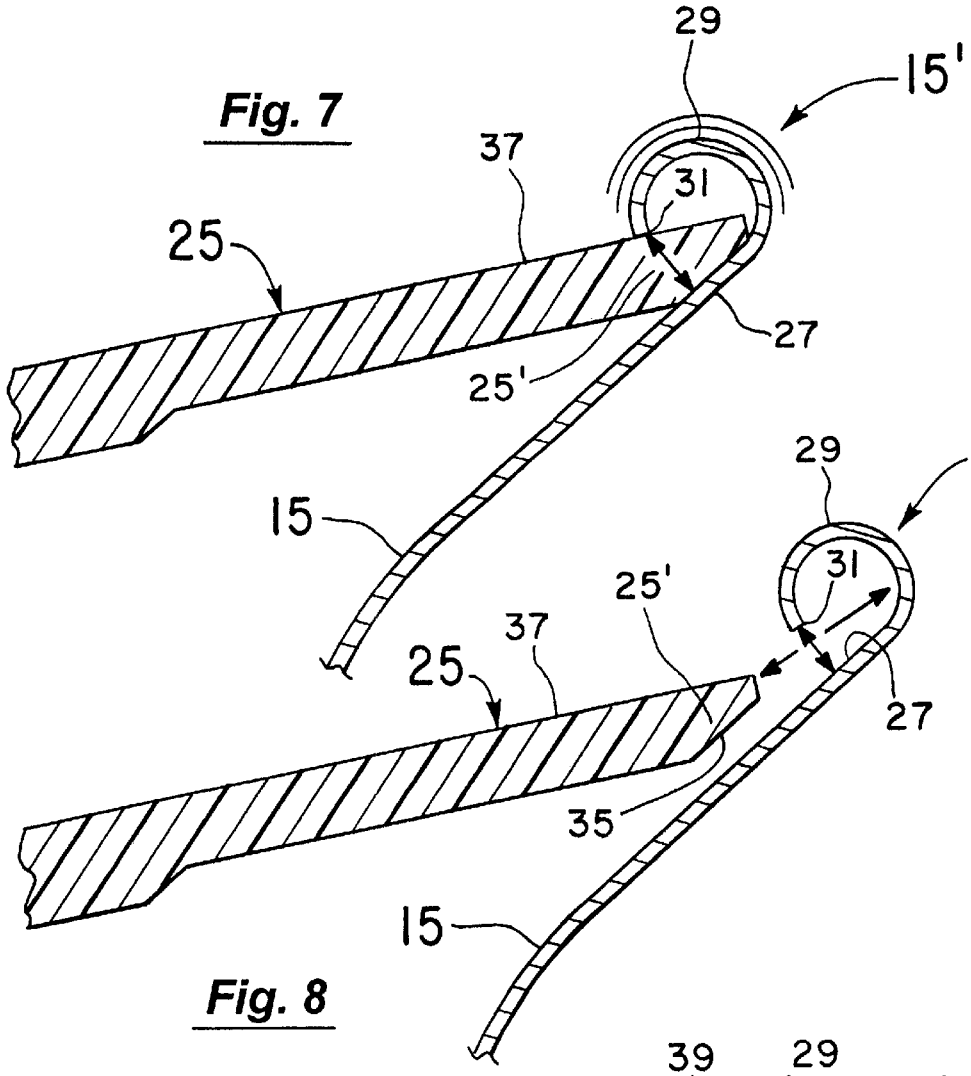
Fig. 7
Fig. 8
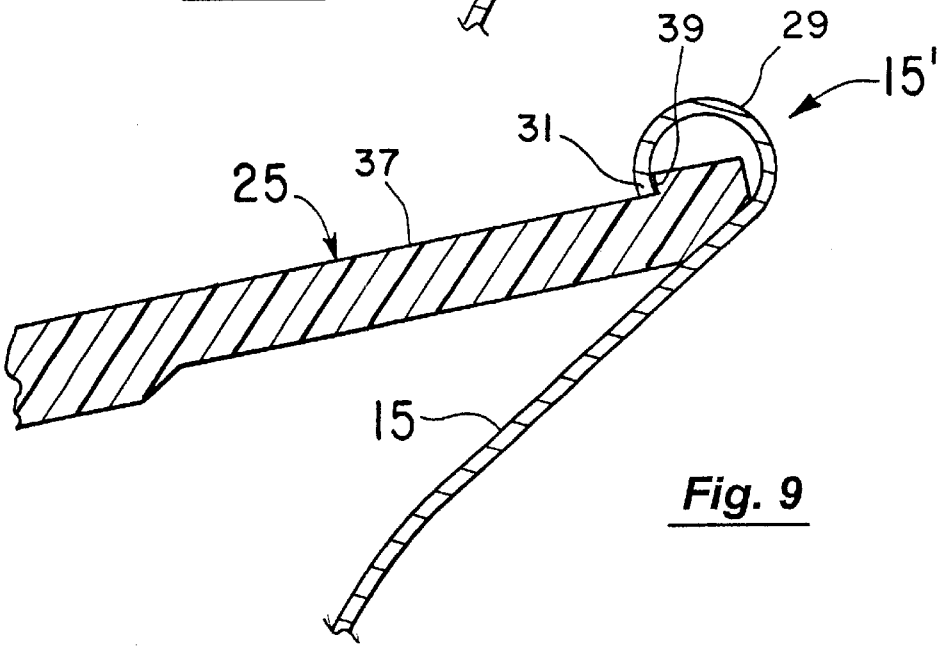
Fig. 9

SPRING-BIASED CUTTING TOOL FOR PLASTIC PIPES

BACKGROUND OF THE INVENTION

1. Field of the Invention

This invention relates to the field of cutting tools for plastic pipes and more particularly to the field of manually operated cutting tools with handles that are spring biased apart to open the jaws of the tool.

2. Discussion of the Background

Cutting tools for plastic pipes are widely used throughout the world and are an essential piece of equipment for virtually anyone who works with plastic pipes. In the typical design, two elongated members are pivotally connected together in a scissors-like manner. In one popular arrangement such as in applicants' U.S. Pat. No. 4,336,652 and D266,736, the handles of the tool are manually manipulated to separate them and open the jaws of the tool to receive the plastic pipe to be cut. In doing so, the handles can be rubbed along the user's leg to separate them and open the tool's jaws or the user can extend his or her fingers to separate the handles. Once opened with the pipe received between the jaws of the tool, the handles can then be squeezed together to drive the edge of the knife blade on one of the jaws into the pipe. At the same time, the tool is normally swung relative to the pipe. In doing so, the knife edge continues to be driven into the pipe until the pipe is eventually severed.

Such cutting tools can be provided with a spring or springs to bias the handles apart and the jaws into an open position to receive the pipe. When a number of cuts are to be done, many users find it more efficient to have a spring-biased tool rather than one whose handles must be manually opened for each cut. Adding a spring, however, increases the complexity and cost to manufacture and assemble the tool. As for example in U.S. Pat. No. 191,416 to Fetter, U.S. Pat. No. 217,583 to Cannon, U.S. Pat. No. 392,717 to Carson, U.S. Pat. No. 929,749 to Bishop, U.S. Pat. No. 1,261,284 to Phelps, U.S. Pat. No. 1,757,173 to Dingman, U.S. Pat. No. 1,802,903 to Bryant, U.S. Pat. No. 2,006,133 to Fowler, U.S. Pat. No. 3,257,723 to Cercone, and U.S. Pat. No. 4,073,059 to Wallace, rivets or screws are necessary to secure the spring to one of the handles. In other patents, the spring must be welded to the tool as in U.S. Pat. No. 1,702,801 to Smith and U.S. Pat. No. 5,058,277 to Kishimoto or special posts must be designed into the tool itself to secure the spring in place as in U.S. Pat. No. 352,560 to Neff, U.S. Pat. No. 3,562,908 to Rogers, U.S. Pat. No. 5,203,084 to Kuo, U.S. Pat. No. 5,860,568 to Mallalieu, and U.S. Pat. No. 5,946,752 to Parrish. Still others require that even more elaborate structure be designed into the tool as in U.S. Pat. No. 4,400,876 to Brown and U.S. Pat. No. 4,633,587 to Harrison or special structure be added to both handles to support the spring as in U.S. Pat. No. 5,930,900 to Chang and British Patent No. 1,196,023 to Rogers. In many cases, such additional complexity and cost to the manufacture and assembly of the tool prices it out of the market.

In contrast, the spring-biased cutting tool of the present invention uses a simple and inexpensive leaf spring with a curved lip on one end that easily clips over a conveniently positioned edge on the tool. In this manner, the spring-biased tool of the present invention can be manufactured and assembled at a cost that is very competitive in the market.

SUMMARY OF THE INVENTION

This invention involves a spring-biased cutting tool for plastic pipes. The tool includes two elongated members pivotally connected to each other in a scissors-like manner. Each elongated member has a handle portion and a jaw portion with one jaw portion including a knife blade and the other an anvil. To assemble the elongated members, one of them is provided with a central aperture or hole through which the other member can be passed to form the scissors-like shape.

In the preferred embodiments, the aperture in the one elongated member is defined by a plurality of edges wherein one edge portion is designed to support an end of a leaf spring. The leaf spring then extends across to abut against the other elongated member of the tool and bias the handles of the tool apart to open the jaws. The attached end of the leaf spring has a curve in it forming a lip. To assemble the spring on the one elongated member, the curved lip is flexed open and pinches the edge portion of the aperture between it and a section of the leaf spring immediately adjacent the lip. In this manner, the leaf spring can be easily and quickly clipped over the edge portion of the aperture on the one elongated member of the tool. The aperture edge portion is preferably pinched between the extreme end or edge of the curved lip and a section of the leaf spring immediately adjacent the lip. The force of the pinch including the physical, frictional engagement of the lip with the aperture edge portion securely keeps the leaf spring in place. In a preferred embodiment, a retaining protuberance or step is added to the structure of the edge portion of the aperture to further ensure that the leaf spring cannot be easily disengage from the tool.

BRIEF DESCRIPTION OF THE DRAWINGS

FIG. 5 is taken along line 5—5 of FIG. 6.

FIG. 7 is an enlarged view taken along line 7—7 of FIG. 5 showing one manner in which the leaf spring can be clipped over and retained on one edge portion of the aperture.

FIG. 8 shows the leaf spring as positioned just before its lip is flexed open to pinch the edge portion of the aperture and assume the clipped on position of FIG. 7.

FIG. 9 illustrates the preferred design of the edge portion of the aperture in which the edge portion is provided with a protuberance or step to aid in retaining the leaf spring on the aperture edge portion.

DETAILED DESCRIPTION OF THE PREFERRED EMBODIMENTS

Figure 1:
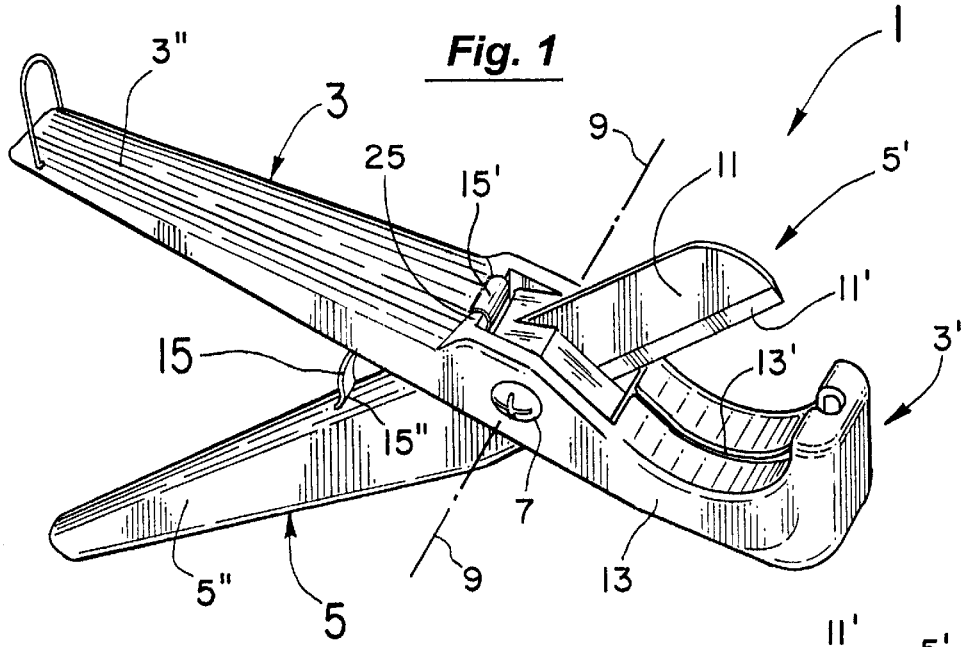
FIG. 1 is a perspective view of the cutting tool of the present invention.

As shown in the perspective view of FIG. 1, the cutting tool 1 of the present invention includes two elongated members 3 and 5. The elongated members 3 and 5 are connected at 7 in a scissors-like manner for pivotal movement relative to each other about the axis 9. The axis 9 as shown is substantially intermediate the respective ends of the members 3 and 5. Each elongated member 3 and 5 has a jaw portion 3' and 5' and a handle portion 3" and 5". The jaw portion 5' of the elongated member 5 (see also FIG. 2) has a knife blade 11 at one end thereof and the opposing jaw portion 3' of the elongated member 3 has a curved anvil 13 at the end thereof.

In operation, the pipe 2 to be cut (see FIG. 2) is first received between the opened jaw portions 3' and 5'. The handle portions 3" and 5" are then manually squeezed together as the cutting tool 1 is preferably swung relative to the pipe 2 until the pipe 2 is severed (see FIG. 3). In doing so as illustrated in FIG. 1–4, the cutting edge 11' of the knife blade 11 is received in the slot 13' (see also FIG. 5) of the anvil 13. Additionally, as the handle portions 3" and 5" are squeezed together from the position of FIG. 2 to the position of FIG. 3, the return spring 15 (see FIGS. 1–3) will be compressed from the relaxed position of FIG. 2 to the compressed position of FIG. 3. Consequently, upon releasing the pressure on the handle portions 3" and 5" in FIG. 3, the compressed return spring 15 will move the handle portions 3" and 5" apart to the position of FIG. 2 to again open and separate the knife blade 11 and anvil 13 to receive another pipe section 2 to be cut.

Figure 5:
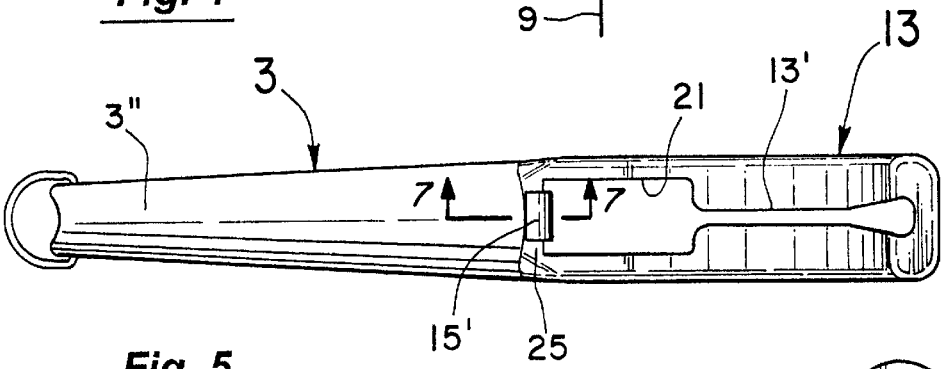
FIG. 5 is a top plan view of the elongated member which has the anvil in it and the central aperture through it to receive the other elongated member.

In the preferred embodiments, the return spring 15 is a leaf spring. Additionally, in the preferred embodiments, the parts of the cutting tool 1 including the elongated members 3 and 5 and the leaf spring 15 have been specifically designed to be easily and cost effectively manufactured and assembled. In this regard as illustrated in FIG. 5, the elongated member 3 is molded with a central aperture 21 extending through it. During assembly, the other elongated member 5 can be positioned as in FIG. 6 and then moved as indicated through the aperture 21 to the relative positioning of FIG. 1, where the two elongated members 3 and 5 can then be secured together at 7 to form the scissors-like shape of the cutting tool 1.

Figure 6:
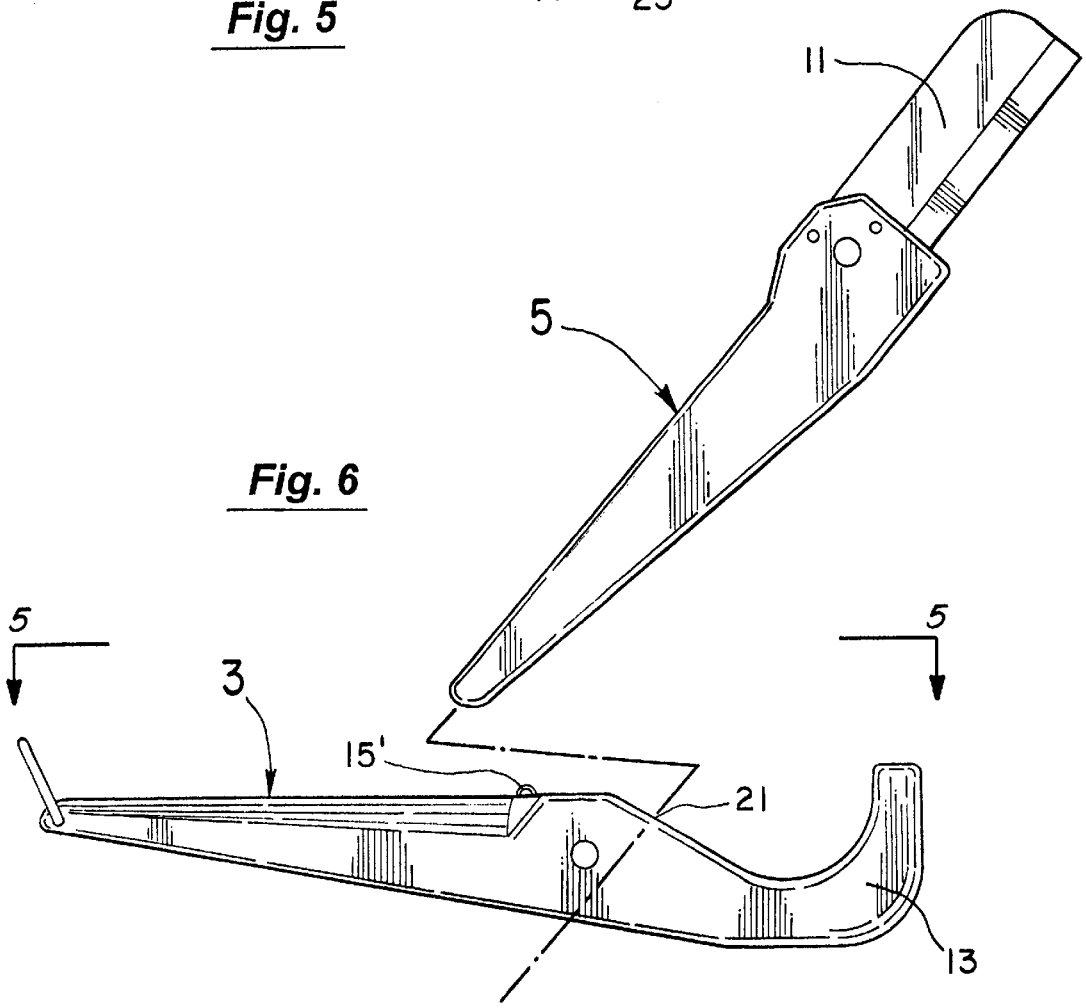
FIG. 6 is a view of the two, elongated members of the tool shown in a pre-assembly position with the one member aligned to be received in the central aperture in the other member.

The leaf spring 15 can be mounted on the elongated member 3 either before the members 3 and 5 are assembled as in FIG. 6 or after the members 3 and 5 are secured together In both cases, the leaf spring 15 only needs be clipped over the edge portion 25 (see FIGS. 5 and 7–8) that defines in part the aperture 21 of FIG. 5. That is, the aperture 21 in FIG. 5 is defined by a plurality of edges including the edge portion 25. This edge portion 25 (see FIG. 7 which is a view taken along line 7—7 of FIG. 5) is specially molded so the leaf spring 15 can be easily and quickly clipped over it.

Figure 2:
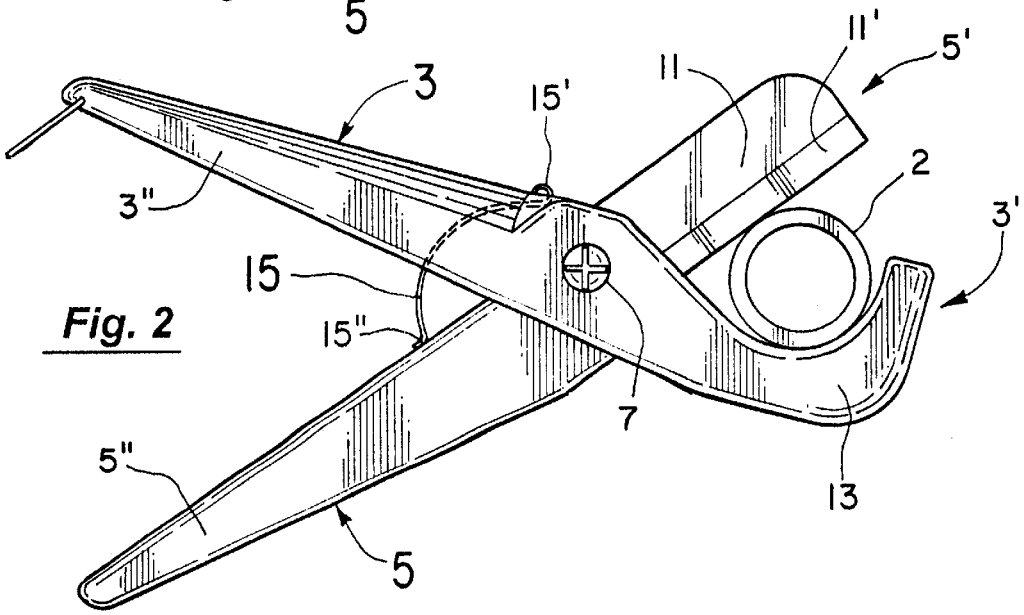
FIG. 2 is a side elevational view of the tool with the handle portions of the tool separated by the force of the spring to open the jaws of the tool to receive the pipe to be cut.
Figure 3:
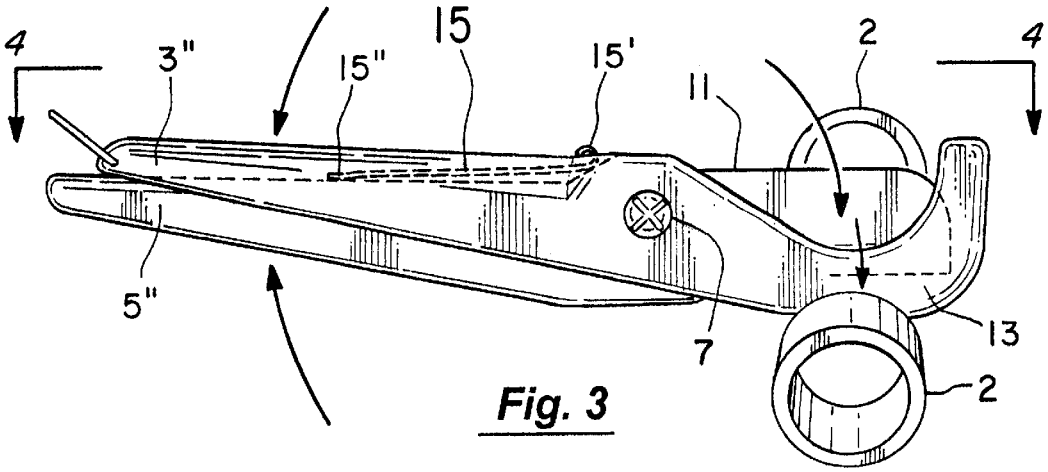
FIG. 3 is a side elevational view of the tool with its handles squeezed completely together to cut through the pipe.
Figure 4:
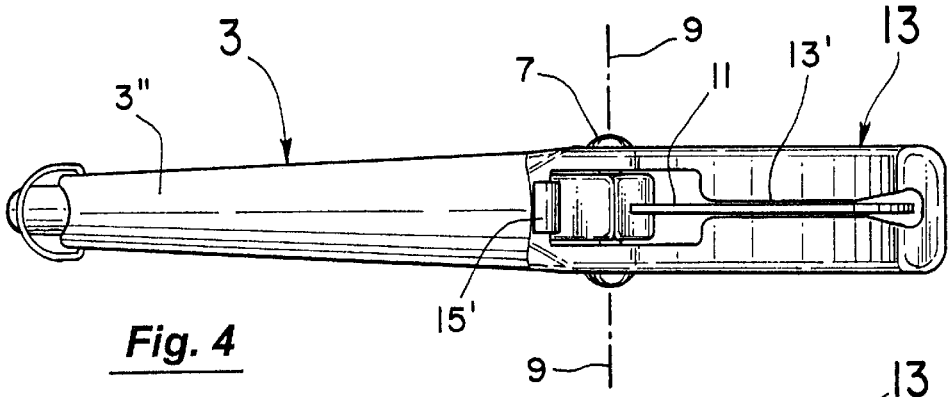
FIG. 4 is a top plan view taken along line 44 of FIG. 3.

More specifically, the leaf spring 15 has first and second end portions 15' and 151" (see FIGS. 2 and 7–8). The end portion 15' as best seen in FIGS. 7 and 8 has a relatively flat section 27 and a curved lip 29 with an end or edge 31. The curved lip or rolled eye 29 in this regard is dimensioned to clip over the edge portion 25 of the aperture 21 in a pinching manner. In assembling the leaf spring on the edge portion 25, the curved lip 29 of FIG. 8 flexes or expands outwardly to receive the tip or end 25' of the edge portion 25 between the lip edge 31 and the relatively flat section 27 of the leaf spring 15 (see FIGS. 7 and 8). In this manner, the curved lip 29 is flexed to pinch the edge portion 25 (see FIG. 7) between the lip edge 31 and the leaf spring section 27 to thereby retain the leaf spring 15 on the edge portion 25. To aid in the flexing or wedging open of the curved lip 29 during assembly, the end 25' of the edge portion 25 as shown in FIGS. 7 and 8 is preferably tapered. This tapered end 25' preferably has a relatively flat, inclined surface 35 (see FIG. 8) against which the flat section 27 of the leaf spring 15 abuts once the leaf spring 15 is clipped and retained on the edge portion 25 as shown in FIG. 7.

In this retained position as best illustrated in FIGS. 1 and 2, the second end portion 15" of the leaf spring 15 is supported to extend toward and abut against the inner or upper surface (see FIGS. 1 and 2) of the opposing handle portion 5' of the elongated member 5 to bias the two handle portions 3" and 5" apart into the open position of FIG. 1. In this relaxed position of FIGS. 1 and 2, the main body of the leaf spring 15 between the end portions 15' and 15" assumes essentially a C-shape as shown. Thereafter, when the handle portions 3" and 5" are squeezed together as discussed above, the leaf spring 15 will assume the substantially flatten and compressed shape of FIG. 3. The free end portion 15" of the leaf spring 15 in this regard has a slight curve or roll as shown. In this manner, the end portion 15" will more easily slide along the handle portion 5" of the elongated member 5, both when the handle portions 3" and 5" are manually squeezed together and when the compressed spring 15 in FIG. 3 returns the elongated members 3 and 5 of the cutting tool 1 to the open position of FIGS. 1 and 2.

In the embodiment of FIG. 7, the lip edge 31 of the leaf spring 15 preferably frictionally engages the surface 37 of the edge portion 25. The frictionally engaged lip edge 31 will then help to retain the leaf spring 15 on the edge portion 25 by digging into the surface 37 in response to forces tending to dislodge the curved lip 29 from the position of FIG. 7 on the edge portion 25. Additionally, the lip edge 31 will physically drag along the surface 37 should a strong enough force be applied to the leaf spring 15 to overcome the pinching force on the edge portion 25 between the lip edge 31 and the opposing, leaf spring section 27.

To more securely clip the leaf spring 15 in place, the edge portion 25 can be modified as in the preferred embodiment of FIG. 9 to include a second surface 39 intersecting the first surface 37 to form a retaining protuberance or step. In this modified design of FIG. 9, the lip end or edge 31 of the leaf spring 15 is then positioned during assembly substantially at the intersection of the two surfaces 37 and 39. Consequently, any force on the leaf spring 15 tending to dislodge the leaf spring 15 from the edge portion 25 will cause the lip edge 31 to abut against the surface 39 of the step or stop and effectively resist any such dislodgement. It is noted this retaining step or stop where surfaces 37 and 39 intersect at approximately 90 degrees acts in addition to the already existing pinching force being applied on the edge portion 25 between the lip edge 31 and the opposing, leaf spring section 27.

While several embodiments of the present invention have been shown and described in detail, it to be understood that various changes and modifications could be made without departing form the scope of the invention.

We claim:

1. A cutting tool (1) primarily intended for cutting plastic pipe (2), said cutting tool including first and second elongated members (3,5) connected to each other for pivotal movement about a pivotal axis (9) between the respective ends (3', 3" and 5',5") of the first and second elongated members, said first elongated member (3) having a curved anvil (13) adjacent one end (3') thereof and a handle portion (3") adjacent the other end, said second elongated member (5) having knife blade (11) adjacent one end (5') thereof and a handle portion (5") adjacent the other end, said knife blade (11) having a cutting edge (11') and said curved anvil (13) of said first elongated member (3) having a slot (13') therein for receiving the cutting edge (11') of said knife blade (11) when said elongated members (3,5) are closed together by squeezing said handle portions (3",5") together, said second elongated member (5) being received in a central aperture (21) through said first elongated member (3), said aperture (21) being defined in part by an edge portion (25) on said first elongated member (3), said cutting tool (1) further including a leaf spring (15) to bias said handle portions (3",5") of said elongated members (3,5) apart to open and separate said knife blade (11) and curved anvil (13) to receive the pipe (2) therebetween, said leaf spring (15) having first and second end portions (15',15"), said first end portion (15') having a substantially curved lip (29) and a section (27) adjacent said curved lip (29), said curved lip (29) having an edge (31) and being dimensioned to clip over the edge portion (25) of the aperture (21) wherein said curved lip (29) is flexed to pinch the edge portion (25) between the edge (31) of the curved lip (29) and said adjacent section (27) of the first end portion (15') of the leaf spring (15) to retain said leaf spring (15) on said edge portion (25) of the aperture (21) with the second end portion (15") of said leaf spring (15) extending to abut against the handle portion (5") of the second elongated member (5) to bias the handle portions (3",5") of the first and second elongated members (3,5) apart.

2. The cutting tool of claim 1 wherein the edge portion (25) of the aperture (21) has a surface (37) frictionally engaged by the edge (31) of the curved lip (29) to help retain the leaf spring (15) on said edge portion (25).

3. The cutting tool of claim 1 wherein the section (27) of the first end portion (15') of the leaf spring (15) adjacent said curved lip (29) is substantially flat and said edge portion (25) of the aperture (21) has a substantially flat surface (35) wherein said flat section (27) of said leaf spring (15) abuts against said flat surface (35) of said edge portion (25) when said curved lip (29) is clipped over said edge portion (25).

4. The cutting tool of claim 1 wherein the edge portion (25) of the aperture (21) has a tapered end (25') insertable between the edge (31) of the curved lip (29) and said adjacent section (27) of the leaf spring (15) to wedge said edge (31) and section (27) apart from each other as said curved lip (29) is clipped over said edge portion (25).

5. The cutting tool of claim 1 wherein the edge portion (25) of the aperture (21) has first and second surfaces (37,39) intersecting one another at an angle to form a retaining step wherein the edge (31) of the curved lip (29) is positioned substantially at the intersection of said surfaces (37,39) and any force tending to dislodge said curved lip (29) from about the edge portion (25) of the aperture (21) causes the edge (31) of the curved lip (29) to abut against one of the surfaces (37,39) and to resist any such dislodgement.

6. The cutting tool of claim 5 wherein said angle between said surfaces (37,39) is substantially 90 degrees.

7. A method of assembling a cutting tool with a leaf spring to bias the handle portions of the cutting tool apart and open the jaw portions of the cutting tool to receive a plastic pipe therebetween, said assembly method including the steps of:

(a) providing first and second elongated members (3,5) with respective jaw portions (3',5') and handle portions (3",5"), (b) inserting the second elongated member (5) through a central aperture (21) in the first elongated member (3) wherein the first and second elongated members (3,5) assume a scissors-like shape, said central aperture (21) being defined in part by an edge portion (25), (c) connecting (7) the two elongated members (3,5) together for movement about a pivotal axis (9) relative to each other, and (d) clipping one end portion (15') of a leaf spring (15) over the edge portion (25) of the aperture (21) with the other end portion (15") of the leaf spring (15) extending to abut against the handle portion (5") of the second elongated member (5) to bias the handle portions (3",5") of the first and second elongated members (3,5) apart and open the jaw portions (3',5') of the cutting tool (1).

8. The assembly method of claim 7 further including the step of providing the edge portion (25) of the aperture (21) with a tapered end (25') insertable between an edge (31) of a curved lip (29) on the one end portion (15') of the leaf spring (15) and a section (27) of the leaf spring (15) adjacent the curved lip (29) to wedge said edge (31) and section (27) apart from each other as the one end portion (15") of the leaf spring (15) is clipped over said edge portion (25) of the aperture (21).

9. The assembly method of claim 7 wherein the edge portion (25) of the aperture (21) is provided with first and second surfaces (37,39) intersecting one another at an angle to form a retaining step and the step (c) of the assembly method further includes the limitation of positioning the edge (31) of the curved lip (29) substantially at the intersection of said surfaces (37,39).

10. The assembly method of claim 9 further including the limitation of intersecting said surfaces (37,39) at substantially 90 degree angle.

* * * * *